US009941614B2

(12) United States Patent
Sato

(10) Patent No.: US 9,941,614 B2
(45) Date of Patent: Apr. 10, 2018

(54) CONNECTION STRUCTURE OF CONNECTOR CAPABLE OF MANAGING A LARGE ELECTRIC CURRENT

(71) Applicant: IRISO ELECTRONICS CO., LTD., Yokohama-shi, Kanagawa (JP)

(72) Inventor: Katsumasa Sato, Yokohama (JP)

(73) Assignee: IRISO ELECTRONICS CO., LTD., Kanagawa (JP)

( * ) Notice: Subject to any disclaimer, the term of this patent is extended or adjusted under 35 U.S.C. 154(b) by 0 days.

(21) Appl. No.: 15/303,566

(22) PCT Filed: Jun. 23, 2015

(86) PCT No.: PCT/JP2015/068034
§ 371 (c)(1),
(2) Date: Oct. 12, 2016

(87) PCT Pub. No.: WO2015/199071
PCT Pub. Date: Dec. 30, 2015

(65) Prior Publication Data

US 2017/0033480 A1 Feb. 2, 2017

(30) Foreign Application Priority Data

Jun. 23, 2014 (JP) ..... 2014-128093

(51) Int. Cl.
*H01R 13/64* (2006.01)
*H01R 12/71* (2011.01)
(Continued)

(52) U.S. Cl.
CPC ..... *H01R 12/716* (2013.01); *H01R 13/04* (2013.01); *H01R 12/91* (2013.01)

(58) Field of Classification Search
CPC .. H01R 12/91; H01R 13/6315; H01R 12/716; H01R 12/52; H01R 9/096; H01R 13/17; H01R 13/187; H01R 13/2442
(Continued)

(56) References Cited

U.S. PATENT DOCUMENTS 4,790,763 A 12/1988 Weber et al.
4,820,169 A 4/1989 Weber et al.
(Continued)

FOREIGN PATENT DOCUMENTS

JP 06-013134 A 1/1994
JP 7-99706 B2 10/1995
(Continued)

OTHER PUBLICATIONS

Office Action for Japanese Patent App. No. 2014-128093 (dated Jul. 30, 2016).
(Continued)

*Primary Examiner* — Hae Moon Hyeon
(74) *Attorney, Agent, or Firm* — Cermak Nakajima & McGowan LLP; Tomoko Nakajima

(57) ABSTRACT

A socket connector includes a housing mounted on a substrate, a plurality of socket terminals that is held by the housing. The plurality of socket terminals is, on one end side thereof, conductively connected to a single connection pad provided in a circuit pattern of the substrate, and is, on the other end side thereof, conductively connected to a plug terminal that is to be a connection mate. Each of the socket terminals includes a substrate connection portion that is fixed to a connection pad, a contact portion that comes into conductive contact with the substrate, and a connection piece portion that connects the contact portion and the substrate connection portion to each other. The connection piece portion including a plurality of branched pieces form-
(Continued)

ing conductive paths that connect, in a parallel manner, the contact portion and the substrate connection portion splits an electric current in a parallel manner.

9 Claims, 20 Drawing Sheets

(51) Int. Cl.
*H01R 13/04* (2006.01)
*H01R 12/91* (2011.01)

(58) Field of Classification Search
USPC ..... 439/247, 248, 74, 862
See application file for complete search history.

(56) References Cited

U.S. PATENT DOCUMENTS 5,112,235 A * 5/1992 Enomoto ..... H01R 12/712 439/246
5,201,663 A * 4/1993 Kikuchi ..... H01R 13/6315 439/248
7,354,279 B2 * 4/2008 Uesaka ..... H01R 12/57 439/660
7,635,274 B2 * 12/2009 Fukazawa ..... H01R 12/716 439/247
7,651,372 B2 * 1/2010 Matsuzaki ..... H01R 13/26 439/607.01
8,267,725 B2 * 9/2012 Zhu ..... H01R 13/2457 439/660
8,657,636 B2 * 2/2014 Wu ..... H01R 13/113 439/862
9,088,113 B2 * 7/2015 Funayama ..... H01R 12/91
9,397,432 B2 * 7/2016 Yukutake ..... H01R 13/46
2010/0029134 A1 2/2010 Matsuzaki et al.
2012/0164893 A1 * 6/2012 Mitsuzuka ..... H01R 13/05 439/692
2015/0024620 A1 1/2015 Kobayashi et al.

FOREIGN PATENT DOCUMENTS

JP 09-249081 A 9/1997
JP 09-320708 A 12/1997
JP 2001-512892 A 8/2001
JP 32899611 B2 3/2002
JP 2008-108559 A 5/2008
JP 2009-123461 A 6/2009
JP 2012-129109 A 7/2012
JP 5491664 B1 3/2014

OTHER PUBLICATIONS

Office Action from Japanese Patent App. No. 2015-125696 dated Jan. 31, 2017.

* cited by examiner

CONNECTION STRUCTURE OF CONNECTOR CAPABLE OF MANAGING A LARGE ELECTRIC CURRENT

CROSS-REFERENCE TO RELATED APPLICATIONS

This application is a national phase entry under 35 U.S.C. § 371 of PCT Patent Application No. PCT/JP2015/068034, filed on Jun. 23, 2015, which claims priority under 35 U.S.C. § 119 to Japanese Patent Application No. 2014-128093, filed Jun. 23, 2014, both of which are incorporated by reference.

BACKGROUND OF THE INVENTION

Field of the Invention

The present invention relates to a connector and a connection structure of the connector, which is capable of managing a large electric current.

Description of Related Art Including Information Disclosed Under 37 CFR 1.97 and 1.98

Various electrical components and electronic equipment mounted in a vehicle operate by electric power from a battery and a control signal, and a wire harness is typically used to transmit the electric power and the signal. Furthermore, in order to adapt to the progress in car electronics technology of recent years, wire harnesses are required to be provided with advanced functions, and for example, one that is capable of managing a large electric current has been proposed (PTL 1, as an example).

CITATION LIST

Patent Literature

PTL 1: Japanese Unexamined Patent Application Publication No. 2009-123461

BRIEF SUMMARY OF THE INVENTION

Technical Problem

However, in recent years, response towards further increase in electric current and high temperature resistance is in need for electric vehicles and hybrid cars. Furthermore, due to sophistication and complication of electrical components and electronic equipment mounted in a vehicle, the wire harnesses that are needed is increasing and a space for wiring the wires needs to be secured. Accordingly, wiring may, disadvantageously, become difficult or the vehicle weight may disadvantageously increase.

The present invention has been made while taking in account the background of the related art described above. An object thereof is to provide a small-sized connector capable of managing a large electric current different from the wire harness.

Solution to Problem

In order to achieve the above object, the present invention is configured in the following manner.

In other words, the present invention provides a connection structure of a connector, including a first connector that conductively connects a connection object to a substrate, the first connector including a housing, and a plurality of terminals that are disposed so as to oppose each other, that hold the connection object in between, and that come into contact with the connection object. The plurality of terminals each include a substrate connection portion that comes into conductive contact with a common connection pad provided on the substrate, a contact portion that comes into conductive contact with the connection object, and a connection piece portion formed of a plurality of branched pieces connecting, in a parallel manner, each substrate connection portion and the corresponding contact portion.

Furthermore, the present invention provides a connector, including a housing mounted on a substrate, and a plurality of terminals held by the housing. Each of the terminals includes a substrate connection portion that conductively connects to a common connection pad provided on the substrate, a contact portion that comes into conductive contact with a common connection object that is a connection mate of the connector, and a connection piece portion formed of a plurality of branched pieces forming parallel conductive paths that connect each of the substrate connection portion and the corresponding contact portion to each other.

The present invention includes a plurality of terminals. In the terminals, substrate connection portions that conductively connect to a common connection pad provided on the substrate and contact portions that come into conductive contact with a common connection object that is a connection mate of the connector are connected in a parallel manner with a connection piece portion formed of a plurality of branched pieces. By so doing, firstly, an electric current can be split in a parallel manner to each of the terminals. Secondly, electric current can be split to each of the terminals in a parallel manner with the connection piece portion. Accordingly, in the connector and the connection structure of the present invention, the electric current can be split in a parallel manner at multiple stages and the resistance value can be lowered enabling the connector and the connection structure to manage a large electric current. Furthermore, by splitting the electric current in the above manner, even if the cross-sectional area of the branched piece that forms the connection piece portion, for example, is formed smaller than those of the other portions of the terminal, heat generation from the connection piece portion can be suppressed.

The plurality of terminals of the present invention may be disposed to oppose each other and be conductively connected with the connection object in between. With the above, conductive contact to the connection object can be made in a reliable manner.

Furthermore, for example, by having the plurality of terminals of the present invention to have the same shape and size with respect to each other, the values of the electric current flowing in each terminal can be equalized. With the above, heat quantity of each terminal can be equalized. Furthermore, by having the cross-sectional area of the branched pieces be the same and, for example, by forming the branched pieces to have the same shape and size, the values of the electric current values in the branched pieces can be equalized. With the above, the heat quantities of the branched pieces can be equalized such that a situation in which one of the branched pieces alone becomes high in temperature can be prevented. Furthermore, by having a plurality of terminals having the same size and shape, no portions of the terminals will be connected to each other; accordingly, compared with, for example, a terminal that is formed by bending a single metal piece and that has a plurality of contact portions, the structure is simple and manufacture thereof is facilitated, and the electric current can be split to each of the terminals in a reliable manner.

The contact portion of the present invention may include a plurality of branch contact portions that form parallel conductive paths. By so doing, since the electric current flowing through the contact portions can be split in a parallel manner to the plurality of branch contact portions and the resistance value can be lowered, the connector can be one in which management of a higher electric current is facilitated. Furthermore, by splitting the electric current, even if the cross-sectional area of the branch contact portion, for example, is formed smaller than those of the other portions of the terminal, heat generation from the contact portion can be suppressed.

The substrate connection portion of the present invention may include a plurality of branch substrate connection portions that form parallel conductive paths. By so doing, since the electric current flowing through the substrate connection portions can be split in a parallel manner to the plurality of branch substrate connection portions and the resistance value can be lowered, the connector can be one in which management of a higher electric current is facilitated. Furthermore, by splitting the electric current, for example, heat generation from the substrate connection portion can be suppressed.

The terminals of the present invention may include a first connection portion connected to the plurality of branch contact portions, and the first connection portion may include first fixing portions that fix the terminals to the housing. With the above, the terminals can, on the branch contact portion side, be fixed to the housing in a reliable manner.

The terminals of the present invention may include a second connection portion connected to the plurality of branched pieces, and the second connection portion may include second fixing portions that fix the terminals to the housing.

With the above, the terminals can, on the branch piece side, be fixed to the housing in a reliable manner.

The housing of the present invention may include a fixed housing and a movable housing relatively displaced with respect to the fixed housing. The substrate connection portion may be provided in the fixed housing, the contact portion may be provided in the movable housing, and the branched pieces of the connection piece portion may be movable pieces that support the movable housing in a relatively displaceable manner with respect to the fixed housing.

Since the branched pieces are movable pieces that supports the movable housing in a relatively displaceable manner with respect to the fixed housing, the connector may be one provided with a floating mechanism. With the above, for example, even in a case in which positional displacement occurs when the contact portion provided on the movable housing side and the connection object are fitted to each other and in a case in which the movable pieces applies vibration to the movable housing, the movable pieces relatively displacing the movable housing with respect to the fixed housing is capable of absorbing the positional displacement. Accordingly, the contact portion and the connection object can be in contact with each other in a reliable manner and a connector becomes high in connection reliability.

In the connector provided with the floating mechanism, typically, it is desirable that a movable piece of a single terminal is formed thin and narrow in a thin shaft shape in order to facilitate elastic deformation in a flexible manner. However, when formed thin and narrow in width, the cross-sectional area thereof becomes smaller and the electric resistance becomes larger. In such a case, when a large electric current is distributed, the movable piece generating heat becomes high in temperature, or in the worst case scenario, may become thermally cut. Conversely, when the cross-sectional area of the movable piece is increased to suppress heat generation, elastic deformation described above will be difficult and, further, it will be difficult to respond to the demand in miniaturization of the collector. When focusing on the movable piece, flexibility in the floating mechanism and managing of a large electric current become a demand evoking a conflict in the existing terminal structure.

Accordingly, different from the conventional terminal in which a single movable piece is provided in a single terminal, in the present invention, a plurality of branched pieces included in the connection piece portion are configured as movable pieces such that heat generation can be suppressed while both increase in the cross-sectional area so as to be capable of being used under a large electric current and flexibility of the movable pieces to manage the floating mechanism are achieved.

The housing of the present invention may accommodate the terminals therein and may include an opening portion that exposes the connection piece portion of the terminals externally. By so doing, the heat of the connection piece portion can be released to the outside and heat release can be facilitated.

The movable pieces of the present invention may each include an elongation portion that is elongated from the substrate connection portion, and a bent portion bent back from an end portion of the elongation portion, and the elongation portion may be formed such that a width on a substrate connection portion side is wider than a width of the bent portion. During fitting, when positional displacement occurs or when vibration is applied to the connector, pressure is applied to the terminals from the connection object. In such a case, in the terminals, there will be a load on the substrate connection portion fixed to the connection pad and on the movable pieces connected to the substrate connection portion. Accordingly, by forming the elongation portion so that the side on the substrate connection portion is wider than the bent portions, the branched pieces, to where the largest load is applied, can be made difficult to become damaged or deformed.

The plurality of terminals of the present invention may be disposed to oppose each other and be in conductive contact with the connection object in between. With the above, the connection object can be held in a reliable manner with the opposing terminals.

Advantageous Effects of Invention

Since the plurality of conductive paths are formed in a parallel manner and the electric current can be split, the connector and the connection structure of the connector of the present invention are capable of managing a large electric current while reducing size.

DETAILED DESCRIPTION OF THE INVENTION

Figure 1:
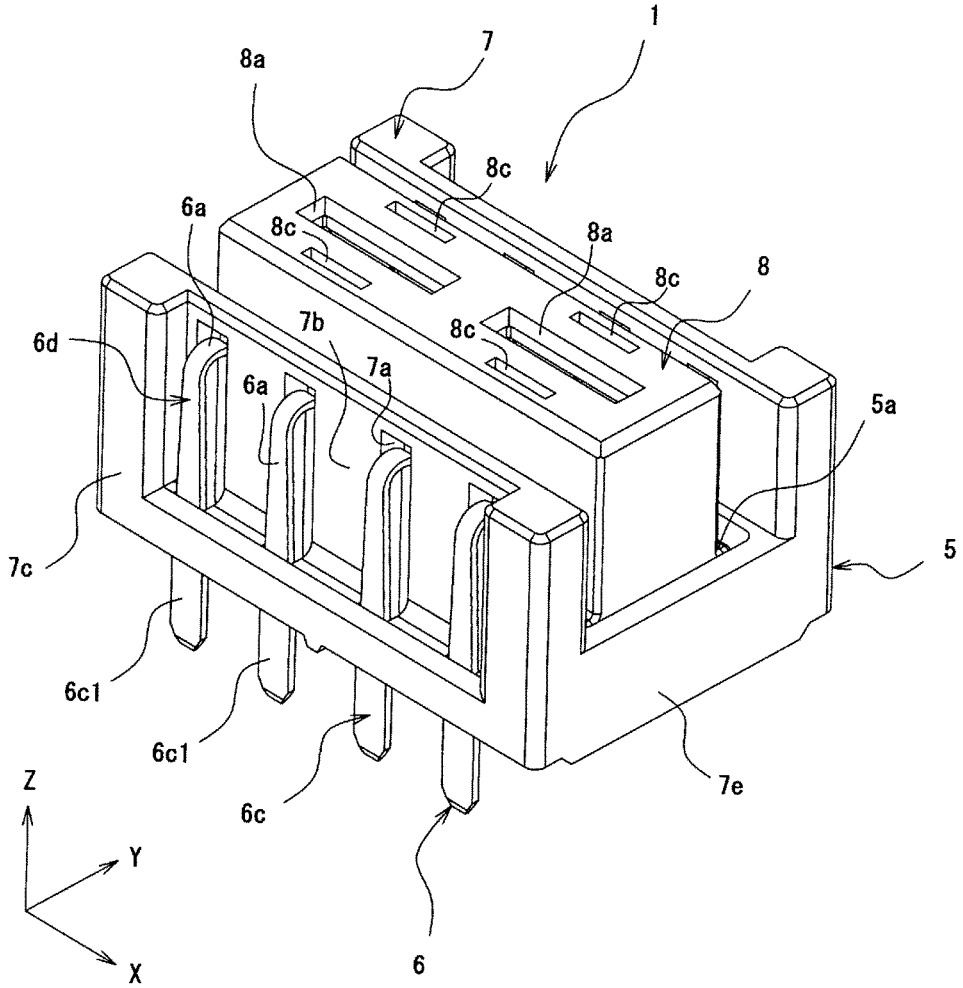
FIG. 1 is a perspective view of a socket connector of a first embodiment.

Hereinafter, embodiments of the present invention will be described with reference to the drawings. Components that are common among each embodiment will be attached with the same reference numerals and redundant description thereof will be omitted.

In the present description, claims, and drawings, description will be given while an X direction is a width direction extending in a longitudinal direction of socket connectors 1 and 9 illustrated in FIGS. 1 to 23, a Y direction is a front-rear direction extending in a short direction, and a Z direction is a height direction of the socket connector 1. In the height direction Z, an "upper side" is a flat surface side of each of the socket connectors 1 and 9 and a "lower side" is a bottom surface side of each of the socket connectors 1 and 9. Note that the directions such as up-down, left-right, and front-rear in the description do not limit the direction in which the connector of the present invention is used.

Note that since a front view and a rear view of each of the socket connectors 1 and 9 are depicted in a similar manner, rear views thereof are omitted. Furthermore, since a right side view and a left side view of each of the socket connectors 1 and 9 and socket terminals 6 and 10 will be depicted in a left-right symmetrical manner, the left side view thereof are omitted.

First Embodiment [FIGS. 1 to 16]

The socket connector 1 serving as a "connector" of the present embodiment is mounted on a first substrate 2 and conductively connects the first substrate 2 and a second substrate 3, which is provided parallel to the first substrate 2, to each other. The socket connector 1 conductively connects the first substrate 2 and the second substrate 3 to each other by being fitted to a plug connector 4 fixed to the second substrate 3.

The socket connector 1 includes a housing 5 mounted on the first substrate 2, and a plurality of socket terminals 6 held by the housing 5. Four socket terminals 6 are provided in the present embodiment. The socket terminals 6 are each of a dual inline package (DIP) type and is installed in connection pads 2*a* and 2*a* (FIG. 2) provided in a circuit pattern of the first substrate 2.

Figure 13:
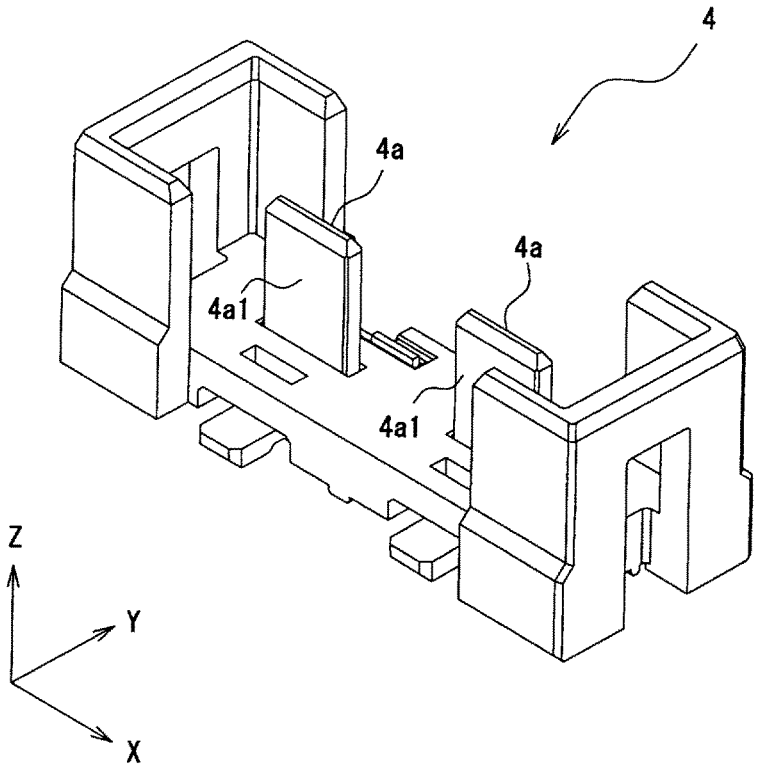
FIG. 13 is a perspective view of a plug connector.
Figure 14:
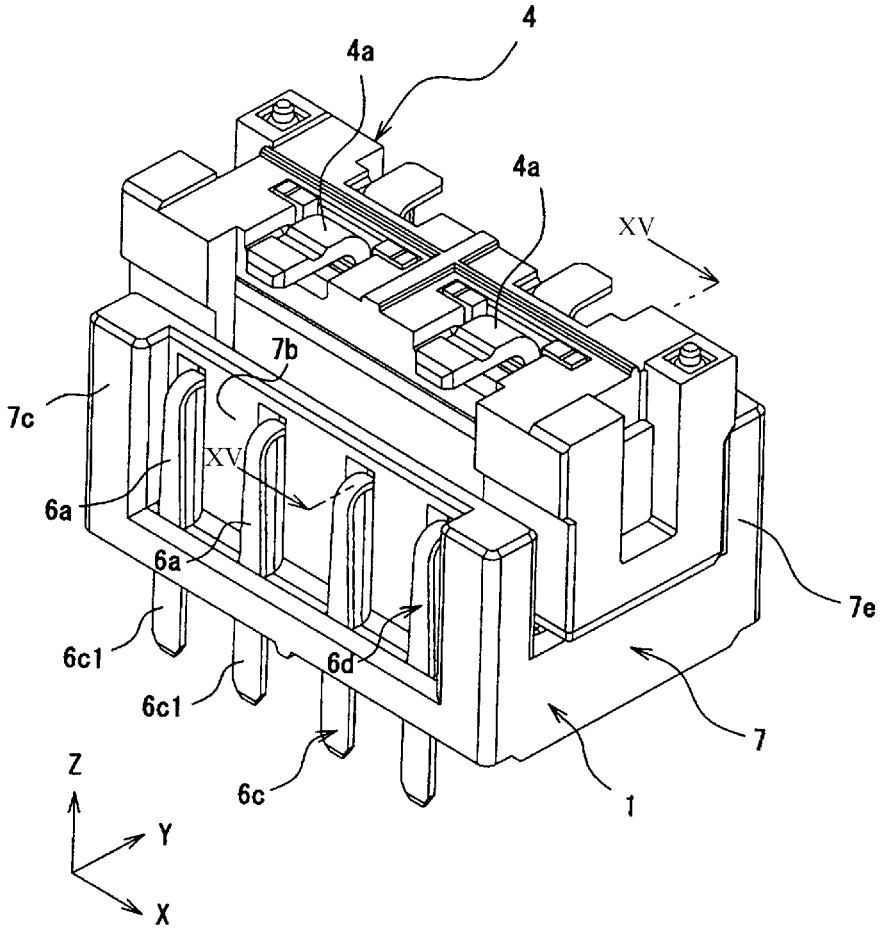
FIG. 14 is a perspective view illustrating a state in which the socket connector and the plug connector are fitted to each other.
Figure 15:
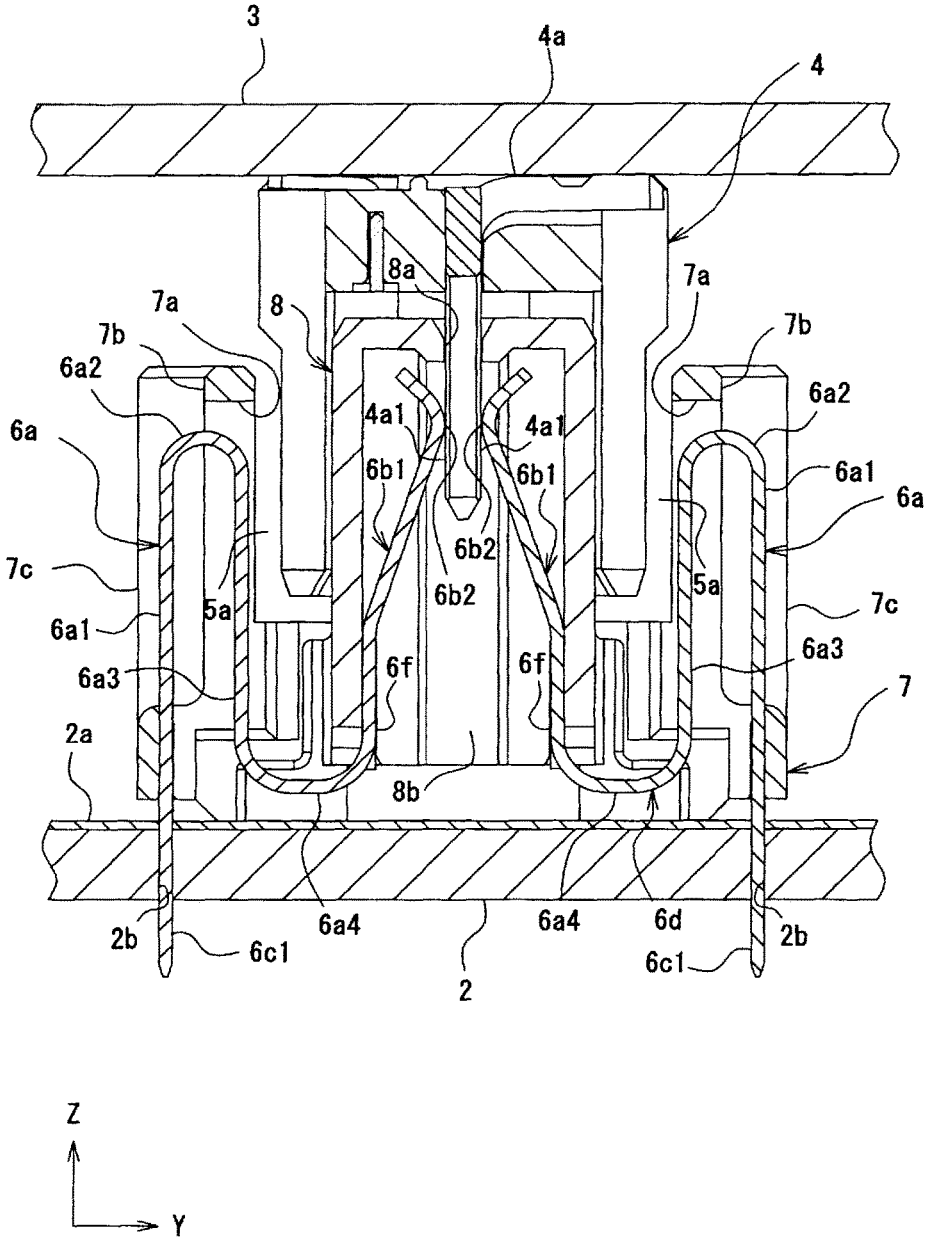
FIG. 15 is a cross-sectional view taken along a line indicated by arrows XV-XV, and illustrates a state in which the socket connector and the plug connector in FIG. 14 are fixed to the substrate.

On the other hand, as illustrated in FIGS. 13 to 15, the plug connector 4 includes plug terminals 4*a* that each serve as a "connection object", and is mounted on the surface of the second substrate 3. Two plug terminals 4*a* are provided in the present embodiment.

[Housing]

The housing 5 is formed of insulating resin, and as illustrated in FIGS. 1 to 6, includes a fixed housing 7 and a movable housing 8.

The fixed housing 7 includes side walls 7*c* that extend in a width direction X of the socket connector 1, side walls 7*e* that extend in a front-rear direction Y of the socket connector 1, inner walls 7*d* each provided in a surface of the corresponding side wall 7*c* and that faces the movable housing 8, opening portions 7*b* each provided on the other surface side of the corresponding side wall 7*c* in a recessed manner, and movable holes 7*a* penetrating the side walls 7*c* and the open in the opening portions 7*b*.

The side walls 7*c* are each provided on the two end sides of the fixed housing 7 in the front-rear direction Y. Furthermore, the side walls 7*e* are each provided on the two end sides of the fixed housing 7 in the width direction X. Furthermore, a movable space 5*a* described later is formed between each side wall 7*c* and the movable housing 8 such that the movable housing 8 can relatively move with respect to the fixed housing 7.

The movable holes 7*a* are provided so as to penetrate through the side walls 7*c* in the front-rear direction Y and are formed in a substantially rectangular shape elongated in a height direction Z. Branched pieces 6*a* of the socket terminals 6 are each inserted into the corresponding one of the movable holes 7*a*.

The opening portions 7*b* are formed in a recessed manner in the surfaces of the side walls 7*c* that is on the opposite side with respect to the inner walls 7*d* and is in communication with the movable holes 7*a*. Portions of the branched pieces 6*a* are externally exposed from the opening portions 7*b*.

The movable housing 8 is formed in a substantially rectangular parallelepiped shape and includes terminal insertion holes 8*a* into which the plug terminals 4*a* of the plug connector 4 are inserted, and an accommodation portion 8*b* that is in communication with the terminal insertion holes 8*a* and that accommodates contact portions 6*b* of the socket terminals 6. In the movable housing 8, heat releasing holes 8*c* are provided on both sides of each of the terminal insertion holes 8*a*. A distal end 6*b*5 of the contact portion 6*b* of each socket terminal 6 is provided adjacent to a corresponding heat releasing hole 8*c* such that the built up heat of the socket terminal 6 is discharged to the outside of the movable housing 8 from the distal end 6*b*5 side.

[Socket Terminal]

The socket terminal 6 is formed of a conducive metal plate and is formed by pressing. Furthermore, four socket terminals 6 are provided in the housing 5, and the four socket terminals 6 all have the same shape and size. As described above, by having a plurality of socket terminals 6 having the same shape and size, no portions of the socket terminals 6 will be connected to each other; accordingly, compared with, for example, a terminal that is formed by bending a single metal piece and that has a plurality of contact portions, the structure is simple and manufacture thereof is facilitated, and, further, electric current can be split to each of the socket terminals 6 in a reliable manner.

As illustrated in FIGS. 7 to 12, each socket terminal 6 includes a substrate connection portion 6*c* fixed to the connection pad 2*a*, the contact portion 6*b* that is brought into conductive contact with the plug connector 4, and a connection piece portion 6*d* that connects the contact portion 6*b* and the substrate connection portion 6*c* to each other. A Corson alloy, for example, is used as the conductive metal described above so that the socket terminal 6 can be adapted to large electric current and is high in conductivity, excellent in resisting heat, and superior in thermal deformation.

Figure 16:
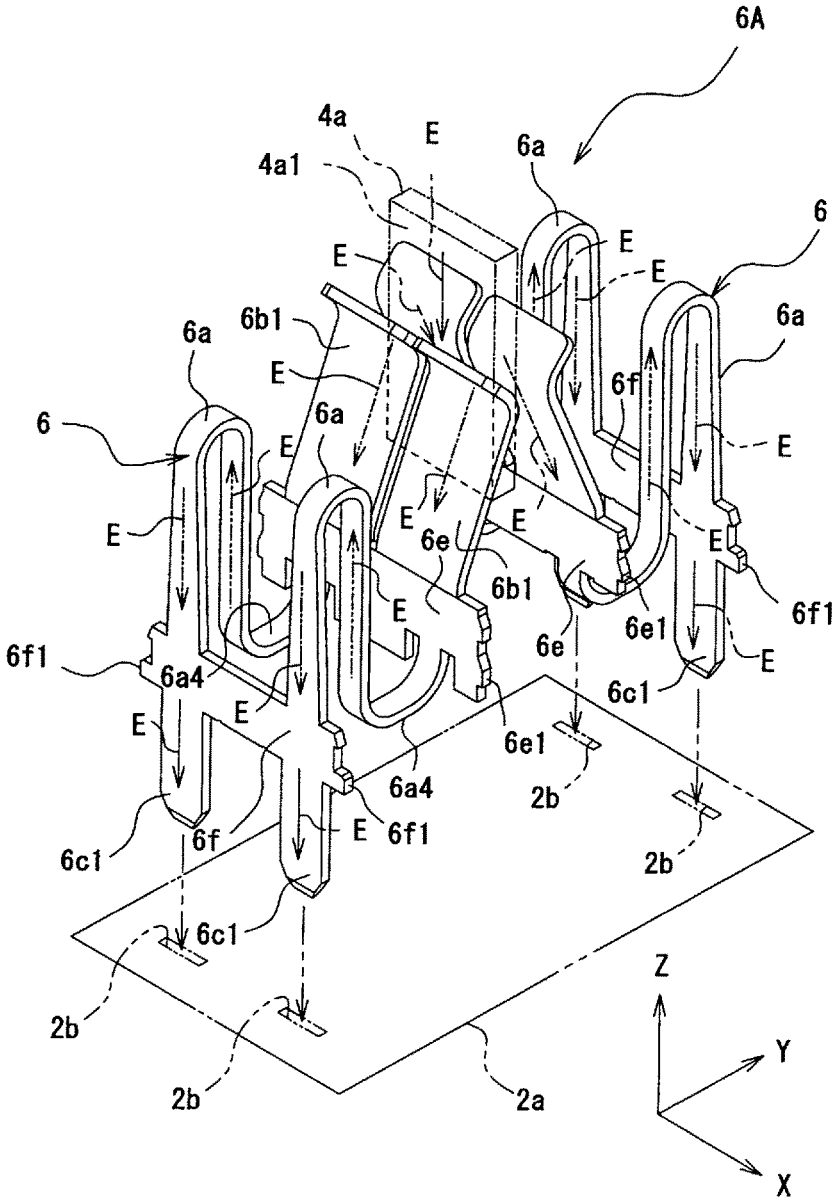
FIG. 16 is an explanatory drawing illustrating a state in which the socket terminal and a plug terminal are in contact with each other.
Figure 17:
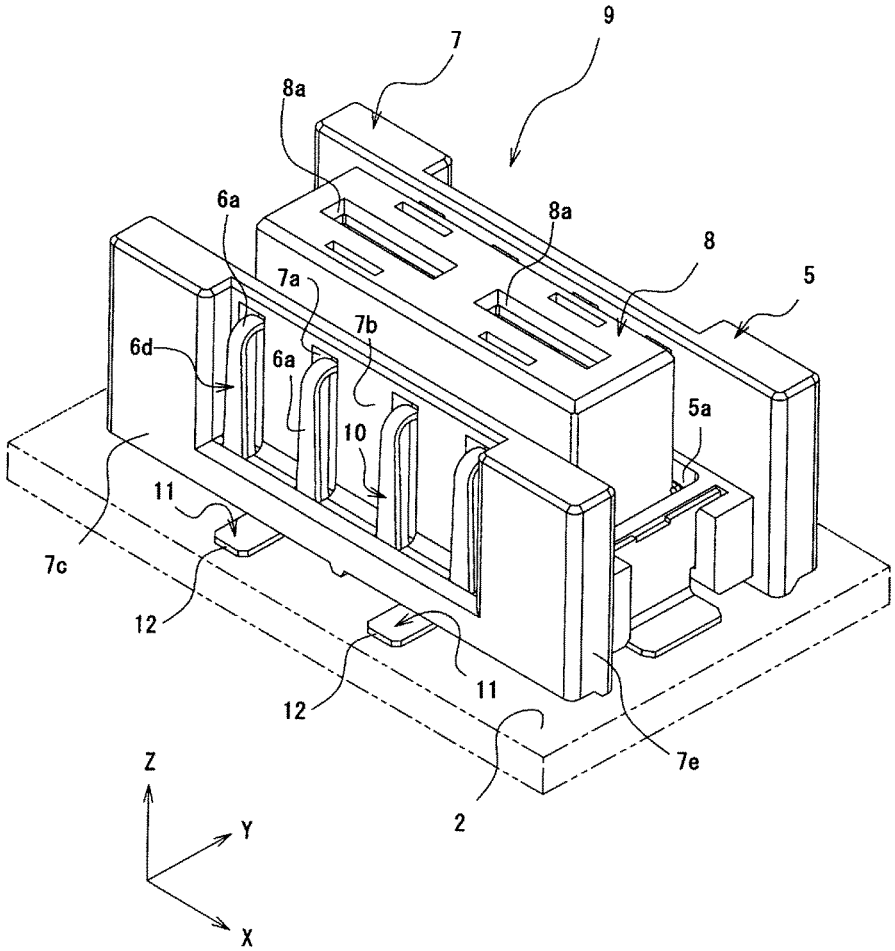
FIG. 17 is a perspective view of a socket connector of a second embodiment.
Figure 18:
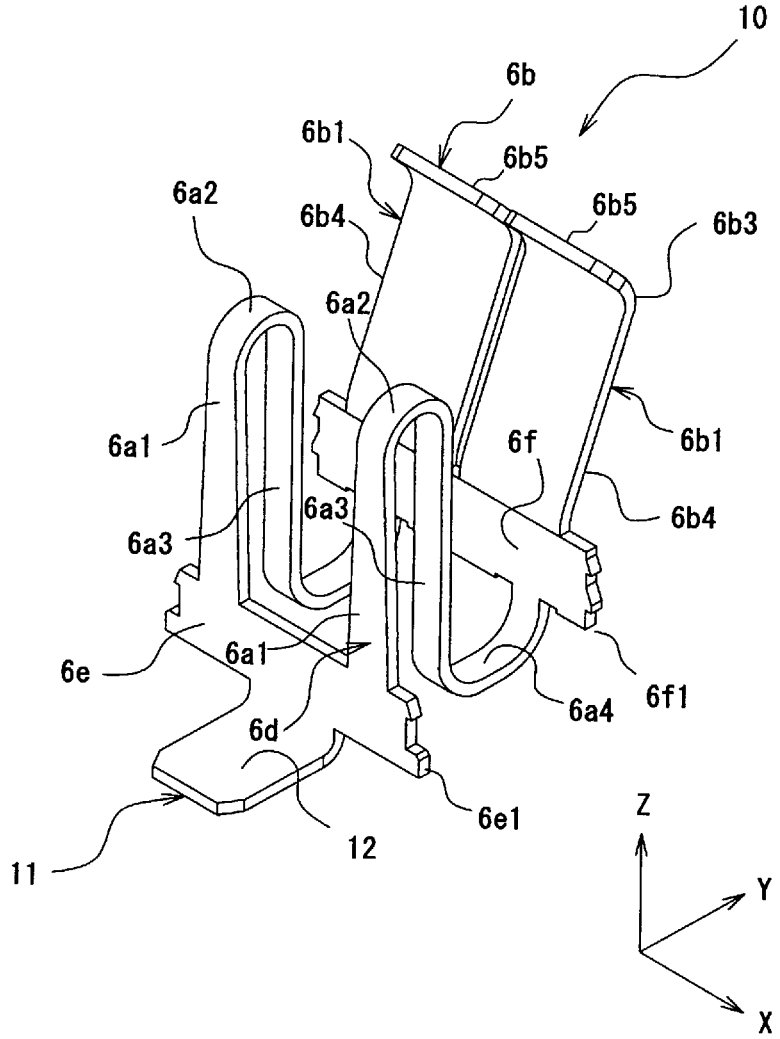
FIG. 18 is a perspective view of a socket terminal in FIG. 17.
Figure 19:
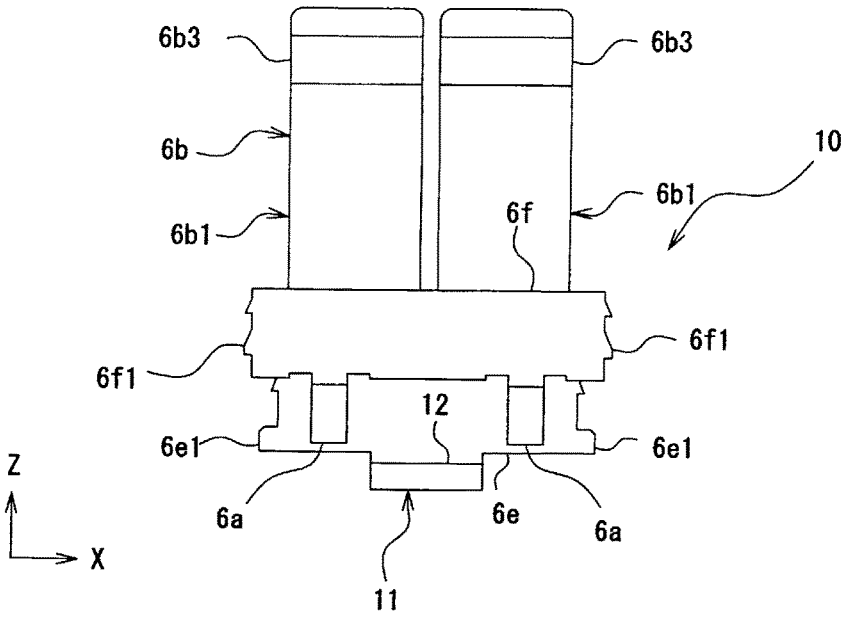
FIG. 19 is a front view of the socket terminal in FIG. 17.
Figure 20:
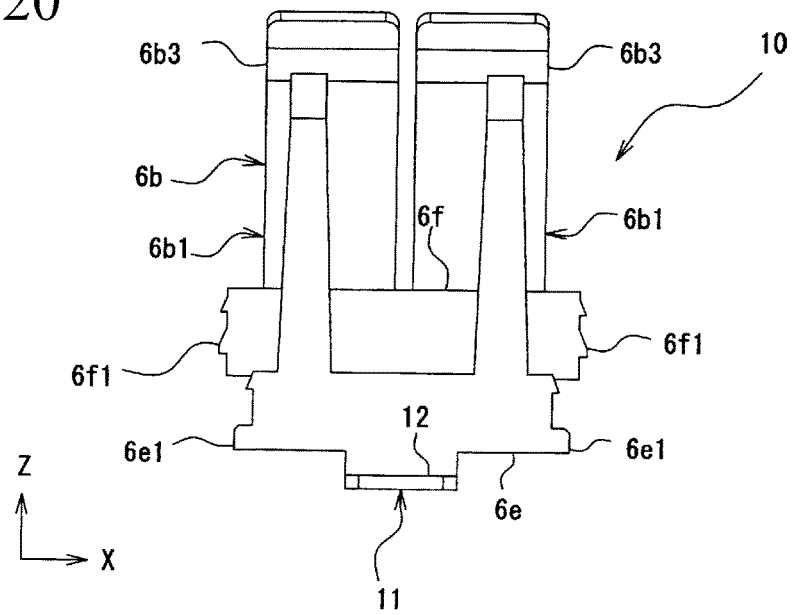
FIG. 20 is a rear view of the socket terminal in FIG. 17.
Figure 21:
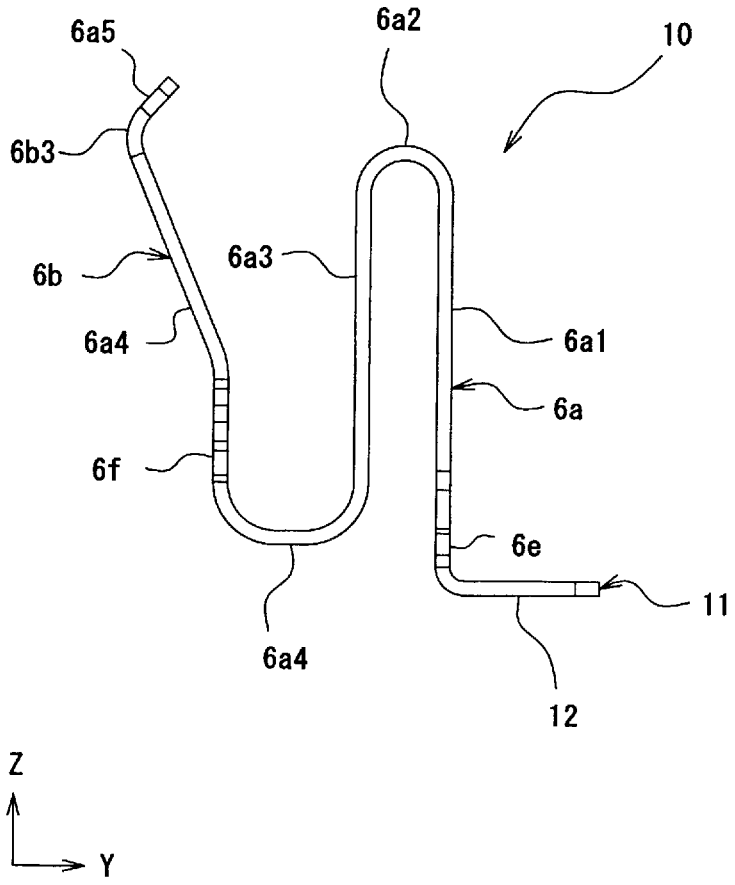
FIG. 21 is a right side view of the socket terminal in FIG. 17.
Figure 22:
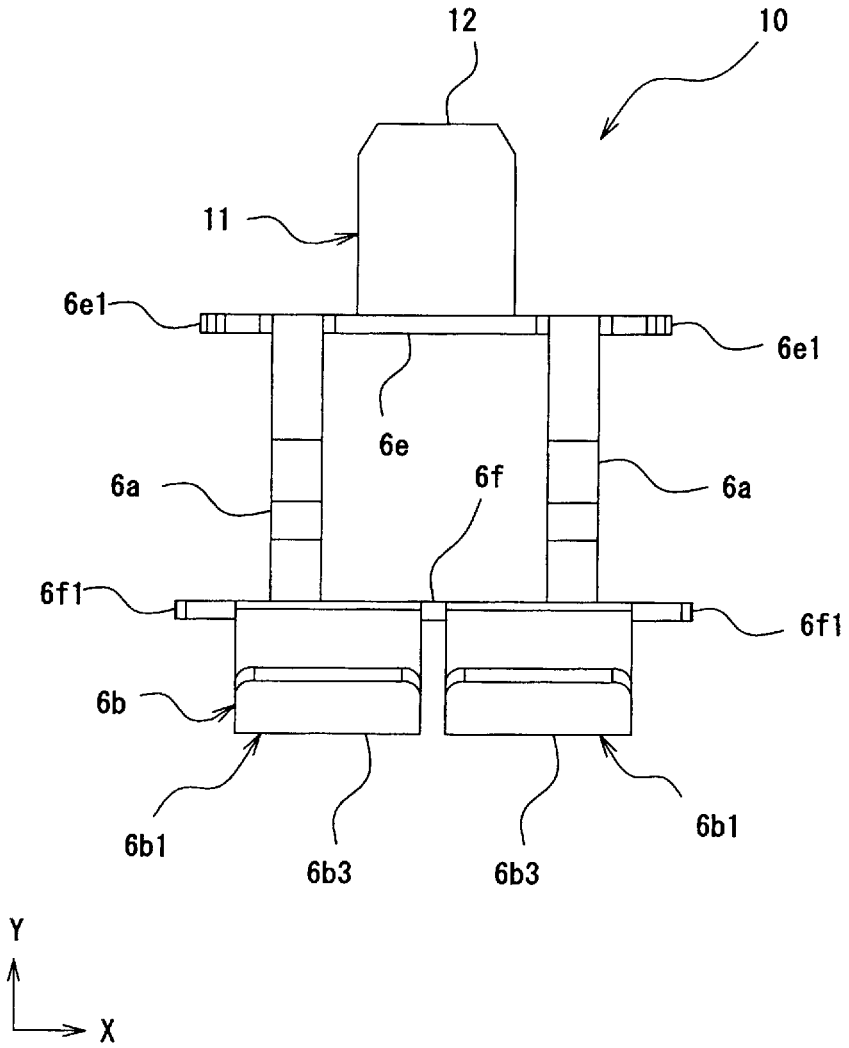
FIG. 22 is a plan view of the socket terminal in FIG. 17.
Figure 23:
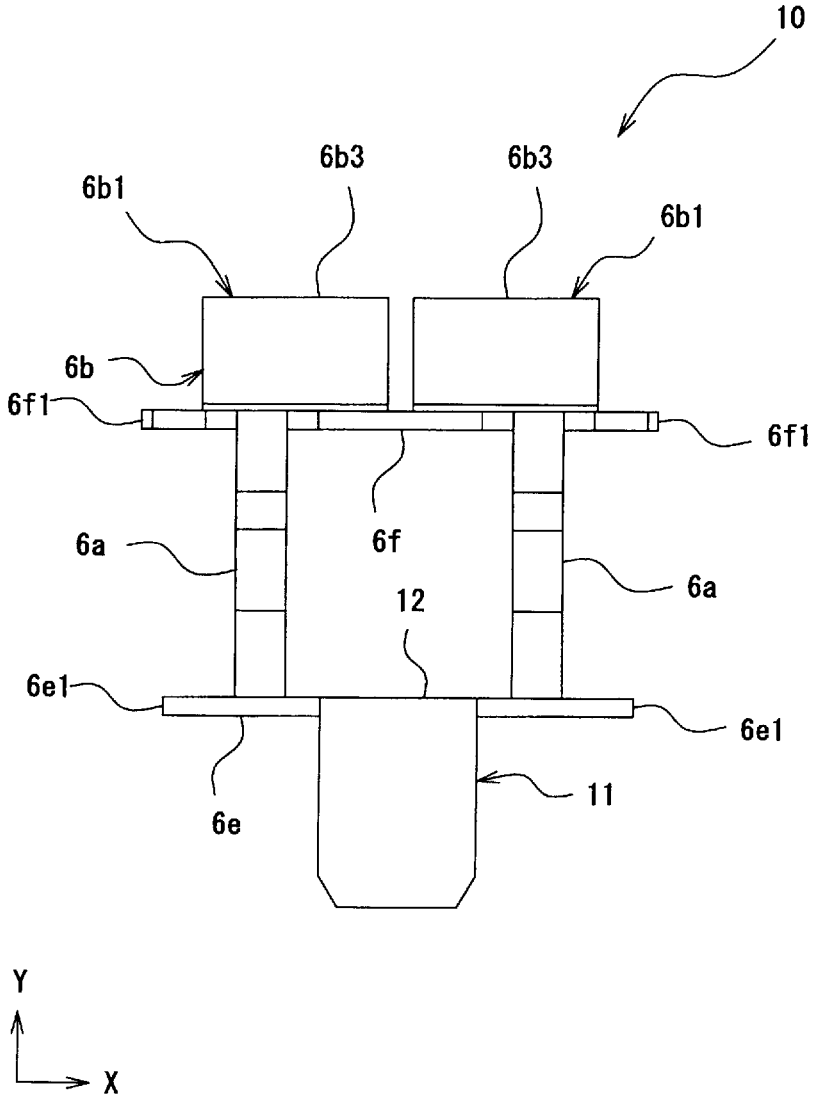
FIG. 23 is a bottom view of the socket terminal in FIG. 17.

The substrate connection portion 6*c* includes two substrate side branch connection pieces 6*c*1 that are provided on one end side of the socket terminal 6 and that, as illustrated in FIG. 16, form parallel conductive paths E. Each of the substrate side branch connection pieces 6*c*1 are formed to have the same shape and size with respect each other. Each socket terminal 6 includes two substrate side branch connection pieces 6*c*1, and the substrate side branch connection pieces 6*c*1 are inserted into through-holes 2*b* provided in the first substrate 2 and are soldered thereto (not shown). With the above, the socket terminals 6 amounted on the first substrate 2.

The connection piece portion 6*d* includes two branched pieces 6*a* and forms a plurality of conductive paths E and E that connect the contact portion 6*b* and the substrate connection portion 6*c* in a parallel manner illustrated in FIG. 16. The branched pieces 6*a* are formed to have the same shape and size with respect each other.

Each branched piece 6*a* includes first vertical piece portions 6*a*1 serving as "elongation portions" that are elongated towards the upper side in the height direction Z of the socket connector 1 from the substrate connection portion 6*c* side, inversed U-shaped portions 6*a*2 serving as "bent portions" that are elongated from the upper ends of the first vertical piece portions 6*a*1 and that are bent back in an inversed U-shape, second vertical piece portions 6*a*3 that are elongated towards the lower side in the height direction Z from the end portions of the inversed U-shaped portions 6*a*2, and horizontal piece portions 6*a*4 that are elongated towards the contact portion 6*b* side in the front-rear direction Y of the socket connector 1 from the lower ends of the second vertical piece portions 6*a*3. The horizontal piece portions 6*a*4 are connected so as to extend into insides of recessed portions 6*f*2 open downwards that are provided in a lower edge of a first connection portion 6*f*. With the above, a spring length of each branched piece 6*a* can be made long such that the branched piece 6*a* can be elastically deformed in a flexible manner. Furthermore, if the horizontal piece portions 6*a*4 are connected to the lower edge of the first connection portion 6*f* without providing the recessed portions 6*f*2, the height positions of the horizontal piece portions 6*a*4 becomes lower and, as a result, the height of the branched pieces 6*a* becomes higher and the total height of the socket connector 1 becomes disadvantageously high. However, by forming the recessed portions 6*f*2, the height positions of the horizontal piece portions 6*a*4 can overlap the height position of the first connection portion 6*f*; accordingly, the entire heights of the branched pieces 6*a* and the socket connector 1 can be made shorter.

The first vertical piece portions 6*a*1 are each formed such that the width thereof becomes wider from an upper side (an inversed U-shaped portions 6*a*2 side) towards a lower side (a branch substrate connection portion 6*c*1 side), and the upper end sides of the first vertical piece portions 6*a*1, the inversed U-shaped portions 6*a*2, the second vertical piece portions 6*a*3, and the horizontal piece portions 6*a*4 are formed such that the plate widths thereof are substantially the same. For example, when fitting the socket connector 1 and the plug connector 4 to each other, if there is positional displacement therebetween or a vibration is applied to the socket connector 1, pressure will be applied to the socket terminals 6 from the plug terminals 4*a*. In such a case, in the socket terminals 6, there will be a load on the substrate side branch connection pieces 6*c*1 fixed to the connection pads 2*a* and on the branched pieces 6*a* connected to the substrate side branch connection pieces 6*c*1. Accordingly, by forming the first vertical piece portions 6*a*1 so that the side on the substrate side branch connection pieces 6*c*1 is wider than the side on the inversed U-shaped portions 6*a*2, the branched pieces 6*a*, to where the largest load is applied, can be made difficult to become damaged or deformed.

The end portions of the two branched pieces 6*a* included in a single socket terminal 6 on the side in which the substrate connection portion 6*c* is provided are connected to a second connection portion 6*e*.

Each contact portion 6*b* in the socket terminal 6 is provided on the other end side that is opposite the one end side in which the substrate connection portion 6*c* is provided and, as illustrated in FIG. 16, includes branch contact portions 6*b*1 and 6*b*1 that form the parallel conductive paths E and E. Each socket terminal 6 is formed to have the same shape and size with respect each other, and each socket terminal 6 includes two branch contact portions 6*b*1. The two branch contact portions 6*b*1 included in a single socket terminal 6 are brought into conductive contact with a single plug terminal 4*a*. Furthermore, each of the branch contact portions 6*b*1 and 6*b*1 is connected, on the other end side, to the connection piece portion 6*d*, and each of the branch contact portions 6*b*1 and 6*b*1 is connected on the connection piece portion 6*d* side through the first connection portion 6*f*.

Furthermore, each branch contact portion 6*b*1 includes a tabular plate surface extending in the width direction X and includes an elastic piece portion 6*b*4 that is inclined and elongated from the position where the branch contact portion 6*b*1 is connected to the connection piece portion 6*d* towards the upper side in a direction (a direction of contact with the plug terminal 4*a* when in a state in which the socket connector 1 and the plug connector 4 are fitted to each other) extending away from the connection piece portion 6*d* so as to be formed in a cantilevered manner. Each branch contact portion 6*b*1 includes a bent portion 6*b*3 at a height position that is substantially the same as that of the upper end portion of the connection piece portion 6*d* and that is on the distal end side of the elastic piece portion 6*b*4. Furthermore, a distal end portion 6*b*5 that is inclined and elongated in a direction that extends towards the upper side and that approaches the connection piece portion 6*d* (in a direction extending away from the plug terminal 4*a* when in the fitted state described above) is included in a portion from the bent portion 6*b*3 to the distal end side. Each bent portion 6*b*3 includes a contact portion 6b2 that is brought into conductive contact with the plug terminal 4a.

[Description of Structure of Connector]

As illustrated in FIGS. 15 and 16, a pair of terminal pair 6A are formed by disposing the socket terminals 6 in a parallel manner while in a state in which the contact portions 6b2 and 6b2 are facing each other in the front-rear direction Y. Furthermore, two terminal pairs 6A are provided in the housing 5 in a parallel manner in the width direction X.

First fixing portions 6f1 and 6f1 having a protruded shape are formed in the two end side in the width direction X of the first connection portion 6f that connects the two branched pieces 6a to each other. Each socket terminal 6 is fixed to the movable housing 8 by having the first fixing portions 6f1 be engaged with first fixing reception portions (not shown) of the movable housing 8. Furthermore, second fixing portions 6e1 having a protruded shape are provided on the two end sides in the width direction X of the second connection portion 6e, which connects the branch contact portions 6b1 to each other on the substrate connection portion 6c side. Each socket terminal 6 can be fixed to the fixed housing 7 by engaging the second fixing portions 6e1 to second fixing reception portions (not shown) of the fixed housing 7. Since the branched pieces 6a included in the connection piece portion 6d and positioned between the first connection portion 6f and the second connection portion 6e are capable of elastically deforming itself as "movable pieces", the branched pieces 6a can support the movable housing 8 in a relatively displaceable manner with respect to the fixed housing 7.

The first vertical piece portions 6a1 and the inversed U-shaped portions 6a2 of the branched pieces 6a are exposed to the outside from the opening portions 7b of the fixed housing 7, and the second vertical piece portions 6a3 are disposed inside the movable holes 7a of the fixed housing 7. Since the movable holes 7a penetrate through the side walls 7c of the fixed housing 7 in the front the front rear direction Y, the second vertical piece portions 6a3 are disposed to the outside as well.

[Description of Method of Fitting Socket Connector and Plug Connector to Each Other]

A state fitted to the socket connector 1 is illustrated in FIGS. 14 and 15. In a case in which the socket connector 1 and the plug connector 4 are fitted to each other, the plug terminals 4a are first inserted into the terminal insertion holes 8a provided in the upper surface of the movable housing 8. The plug terminals 4a are further inserted into the accommodation portion 8b of the movable housing 8, and the distal ends of the plug terminals 4a are inserted between the contact portions 6b and 6b of the socket terminals 6 and 6 forming the terminal pairs 6A. Subsequently, the plug terminals 4a push and widen the portions between the contact portions 6b and 6b and are inserted between the contact portions 6b2 and 6b2. Subsequently, by inserting the plug terminals 4a deep into the accommodation portion 8b, the contact surfaces 4a1 of the plug terminals 4a and the contact portions 6b2 and 6b2 of the socket terminals 6 are brought into conductive contact with each other such that the plug terminals 4a and the socket terminals 6 become conductively connected to each other. Fitting of the socket connector 1 and the plug connector 4 to each other is completed in the above manner.

[Description of Electric Current Splitting Effect of Socket Connector]

Figure 2:
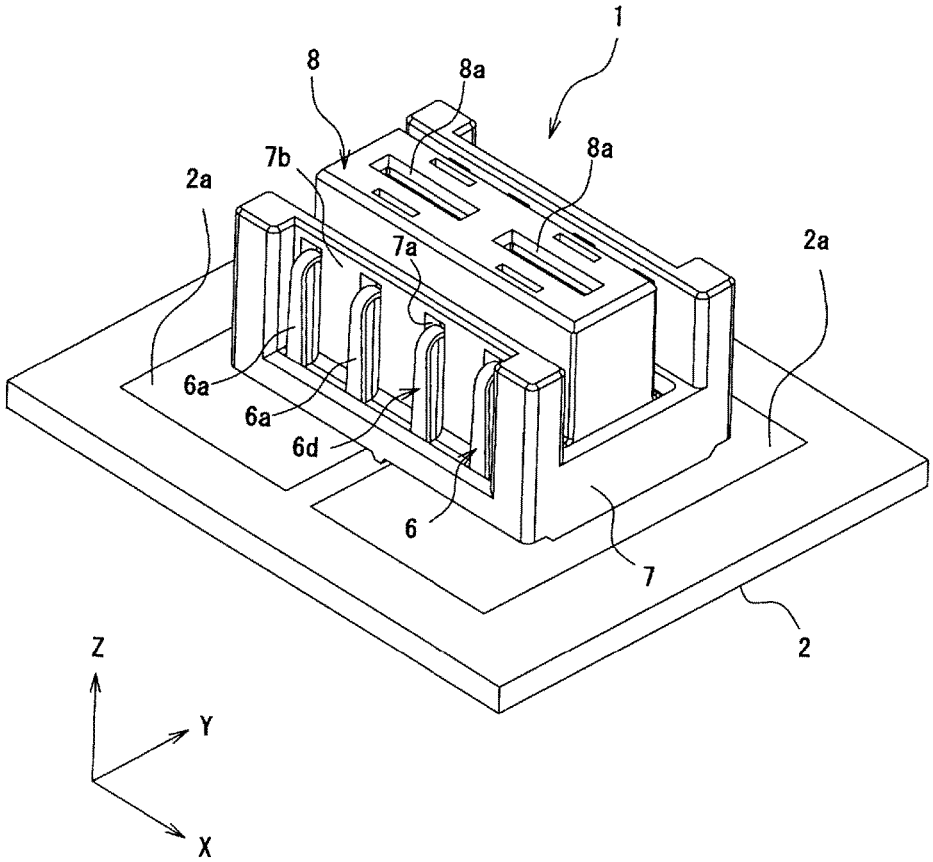
FIG. 2 is an explanatory drawing illustrating a state in which the socket connector in FIG. 1 is installed on a substrate.
Figure 3:
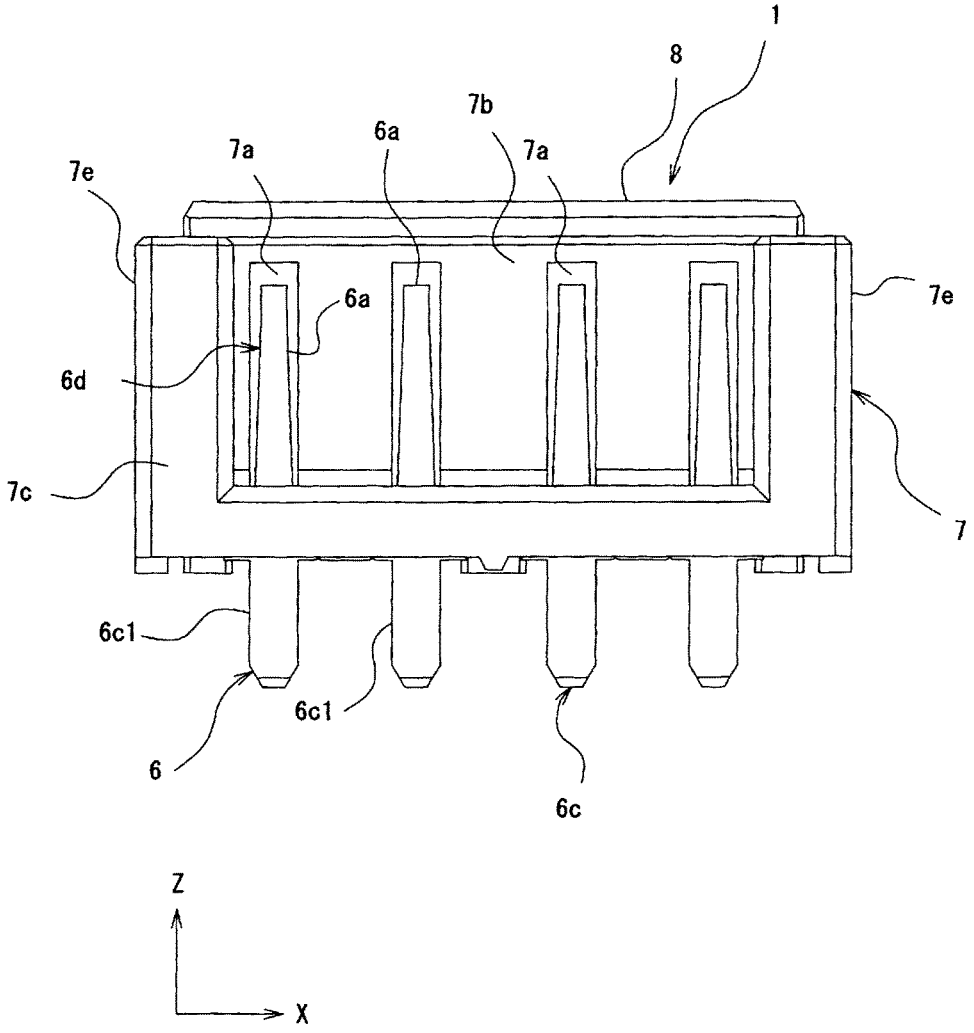
FIG. 3 is a front view of the socket connector in FIG. 1.
Figure 4:
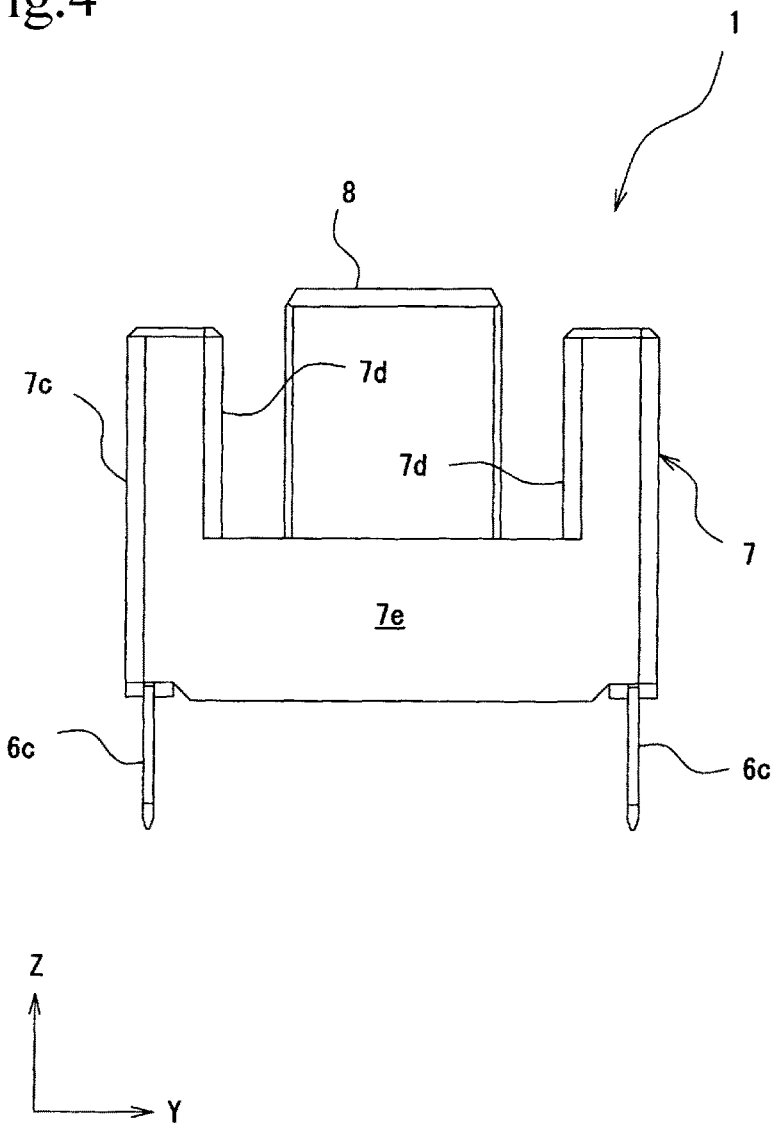
FIG. 4 is a right side view of the socket connector in FIG. 1.
Figure 5:
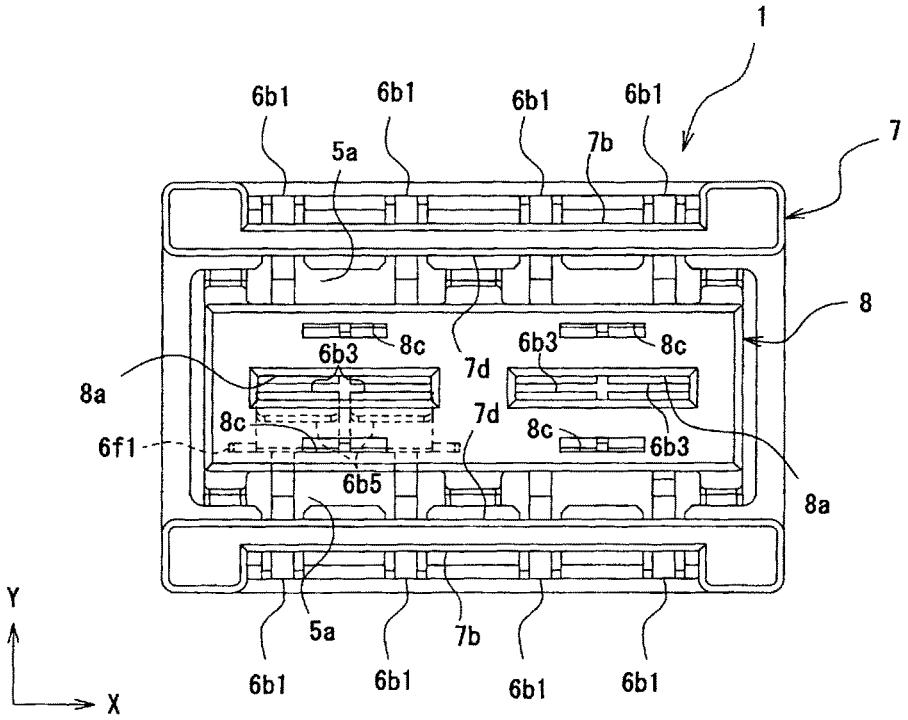
FIG. 5 is a plan view of the socket connector in FIG. 1.
Figure 6:
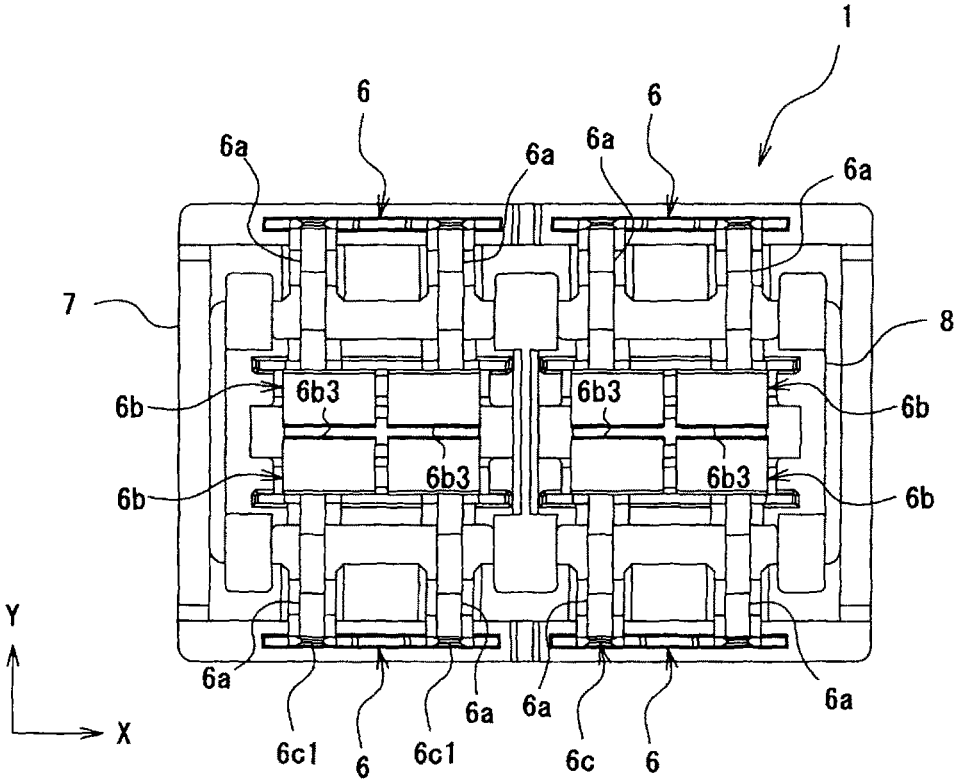
FIG. 6 is a bottom view of the socket connector in FIG. 1.
Figure 7:
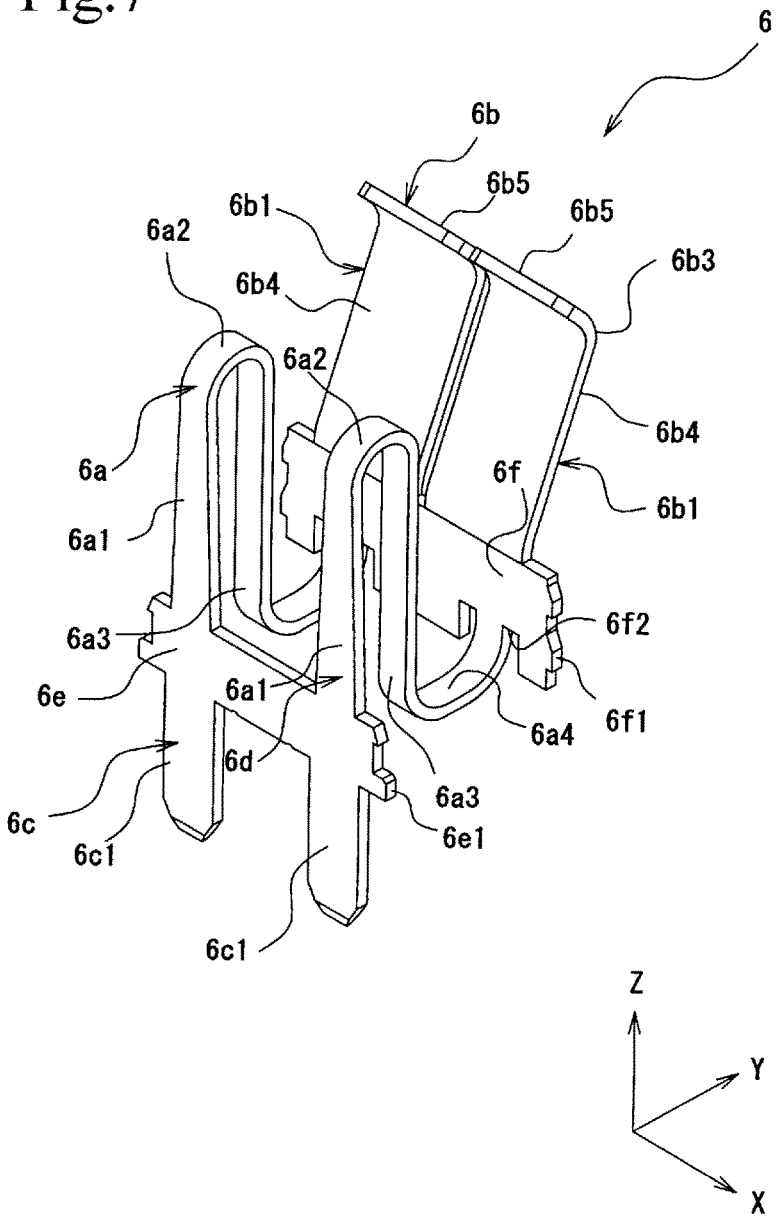
FIG. 7 is a perspective view of a socket terminal in FIG. 1.
Figure 8:
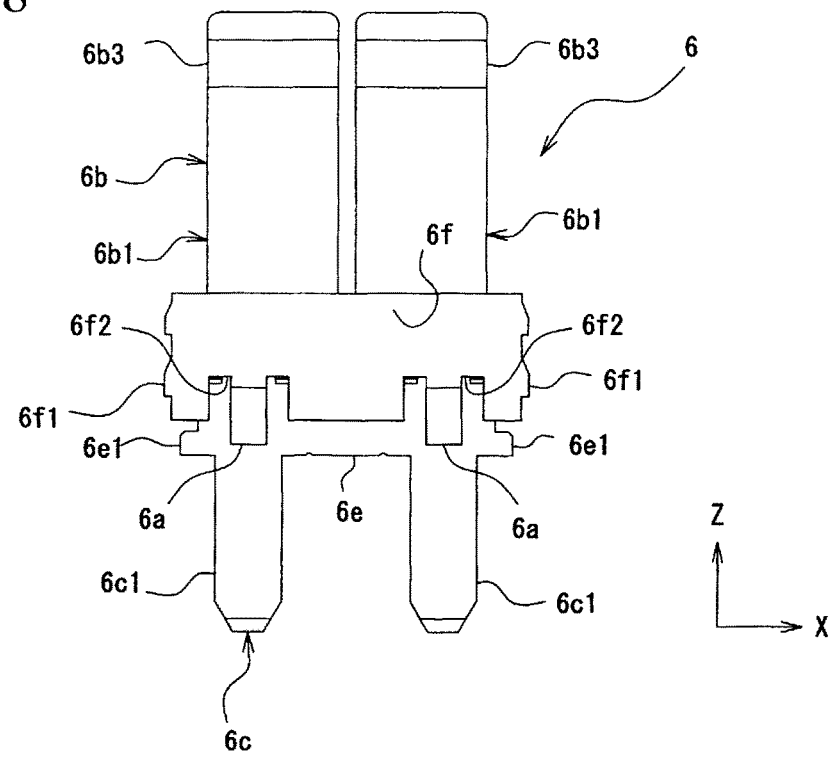
FIG. 8 is a front view of the socket terminal in FIG. 1.
Figure 9:
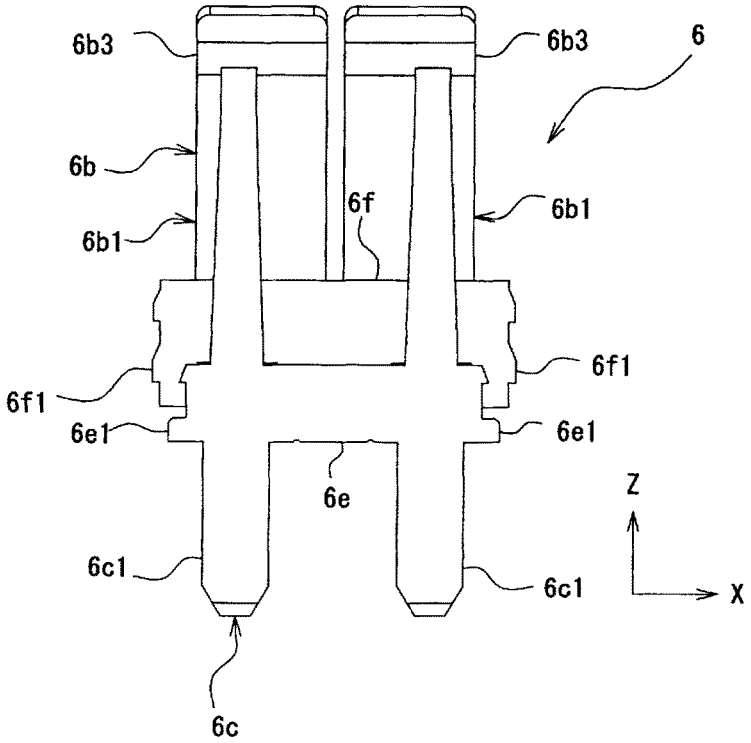
FIG. 9 is a rear view of the socket terminal in FIG. 1.
Figure 10:
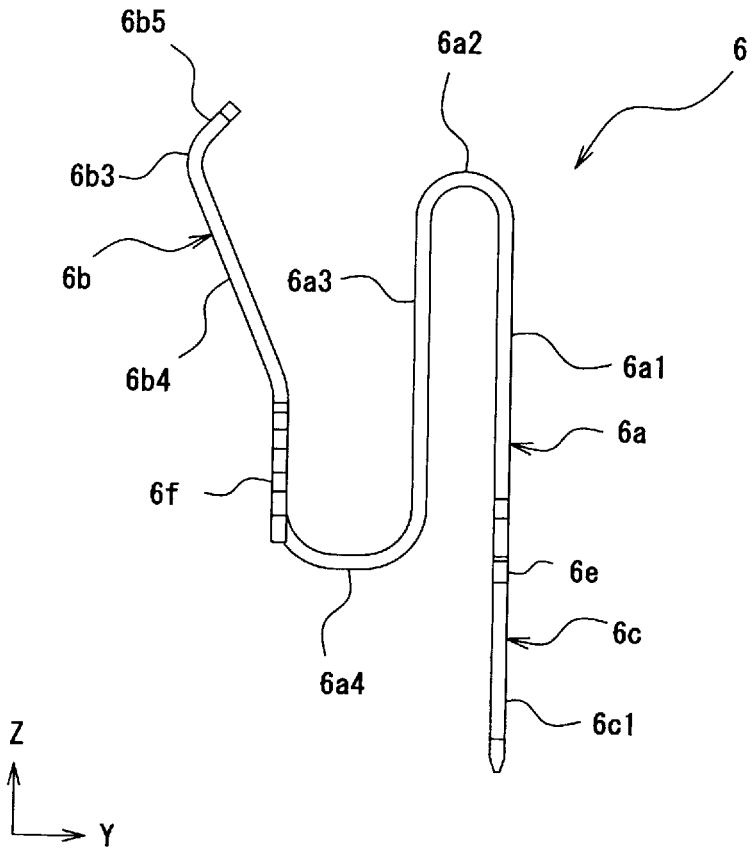
FIG. 10 is a right side view of the socket terminal in FIG. 1.
Figure 11:
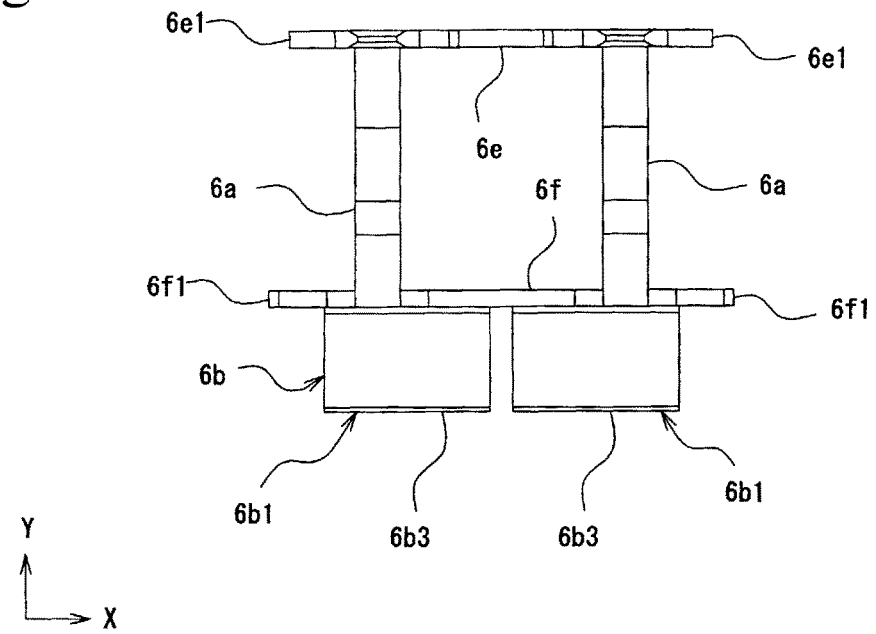
FIG. 11 is a plan view of the socket terminal in FIG. 1.
Figure 12:
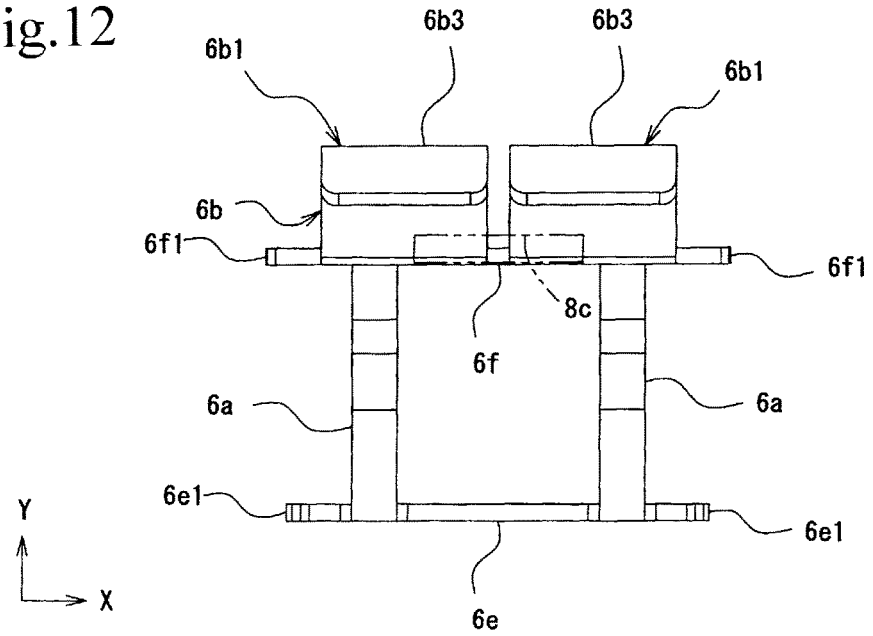
FIG. 12 is a bottom view of the socket terminal in FIG. 1.

A circuit pattern formed of copper foil is provided on the first substrate 2, and as illustrated in FIGS. 2 and 16, the connection pads 2a and 2a are provided for connecting the socket terminals 6. The socket connector 1 includes two pairs of terminal pairs 6A (four mutually independent socket terminals 6). A pair of terminal pair 6A (the socket terminals 6 and 6) among the two pairs of terminal pairs 6A are connected to a single and common connection pad 2a (FIG. 16). Accordingly, an electric current flowing into the socket connector 1 through a single plug terminal 4a can be split to the two socket terminals 6 and 6 in a parallel manner and connection can be made to a single and common connection pad 2a; accordingly, the resistance value can be lowered. Accordingly, the socket connector 1 can be one in which management of a large electric current is facilitated.

The plug connector 4 includes the two plug terminals 4a and 4a that are independent of each other, and an electric current flows into the plug terminals 4a and 4a through the two paths formed in the substrate 3.

The contact portion 6b of one of the socket terminals 6 and the contact portion 6b of the other one of the socket terminals 6 that form a terminal pair 6A come into conductive contact with a single plug terminal 4a.

Specifically, as illustrated in FIG. 16, the two branch contact portions 6b1 of each of the contact portions 6b of the one and the other one of the socket terminals 6 that oppose each other hold the plug terminal 4a in between so as to establish a conductive contact. In so doing, even if the terminal surfaces 4a1 of the plug terminals 4a come in contact with the branch contact portions 6b1 in an inclined manner or even if there is unevenness on the terminal surfaces 4a1 of the plug terminals 4a, since the opposing socket terminals 6 are formed independently and the branch contact portions 6b1 and 6b1 elastically deform independently, the branch contact portions 6b1 of each of the terminals 6 can follow the terminal surface 4a1 of the corresponding plug terminal 4a. Accordingly, contact with the plug terminals 4a can be maintained in a reliable manner.

In the above manner, in the socket connector 1, the electrical current from a single plug terminal 4a is split to the two socket terminals 6 in a parallel manner and, further, is split into two branch contact portions 6b1 in each of the socket terminals 6 in a parallel manner; accordingly, the resistance value can be lowered. Accordingly, the connector can be one in which management of a larger electric current is facilitated.

Since the electric current that has passed through the branch contact portions 6b1 and 6b1 is, then, split to the two branched pieces 6a and 6a in a parallel manner, the resistance value of the connection piece portion 6d can be lowered. Accordingly, similar to the above, the socket connector 1 can be one in which management of a larger electric current is facilitated.

Since the electric current that has passed through the branched pieces 6a and 6a is, then, split to the two substrate side branch connection pieces 6c1 and 6c1 in a parallel manner, the resistance value of the entire substrate connection portion 6c can be lowered. Accordingly, the socket connector 1 can be one in which management of a larger electric current is facilitated.

Furthermore, since each socket terminal 6 includes two substrate side connection pieces 6c1, a terminal pair 6A includes four substrate side connection pieces 6c1 in total. A plurality of through-holes 2b are formed in the connection pads 2a, and by inserting the substrate side connection pieces 6c1 of the socket terminals 6 therein and by performing soldering, the socket terminals 6 is fixed to the substrate 2.

The through-holes 2b and 2b are provided in a single and common connection pad 2a, and each of the substrate side branch connection pieces 6*c*1 and 6*c*1 are inserted into a different one of the through-holes 2*b* and 2*b* and are fixed. Accordingly, the two socket terminals 6 included in a pair of terminal pair 6A can be conductively connected to a single connection pad 2*a*.

Each substrate side branch connection piece 6*c*1 and the first vertical piece portion 6*a*1 of the corresponding branched piece 6*a* of the present embodiment are each formed into a plate-like piece and are disposed on a single linear axis extending in the height direction Z. By doing so, compared with a case in which the substrate side branch connection piece 6*c*1 and the first vertical piece portion 6*a*1 are provided on different axes or in which the substrate side branch connection piece 6*c*1 and the first vertical piece portion 6*a*1 are formed in a curved manner, the conductive paths E can be formed in the short and straight manner; accordingly, the resistance value can be lowered. Furthermore, even in a case described later in which a floating mechanism is actuated and the branched pieces 6*a* are deformed, the load can be distributed to the entire substrate side branch connection pieces 6*c*1 and first vertical piece portions 6*a*1 in a uniform manner. Accordingly, damage and the like of the socket terminals 6 can be made to not easily occur.

[Description of Movable Mechanism]

The floating mechanism in the front-rear direction Y provided in the socket connector 1 will be described first. The movable spaces 5*a* are provided between the movable housing 8 and the side walls 7*c* extending in the width direction X of the fixed housing 7, and, in the movable spaces 5*a*, the movable housing 8 can be relatively displaced in the front-rear direction Y with respect to the fixed housing 7. Furthermore, the horizontal piece portion 6*a*4 is provided in the branched piece 6*a* of each connection piece portion 6*d* in the socket terminal 6. Since each horizontal piece portion 6*a*4 is provided so as to be connected to the corresponding first fixing portion 6*f*1 fixed to the movable housing 8, the corresponding branched piece 6*a* of the socket terminal 6 elastically deforms in accordance with the movement of the movable housing 8. Specifically, since each horizontal piece portion 6*a*4 is connected to the lower end of the corresponding second vertical piece portion 6*a*3, the second vertical piece portion 6*a*3 elastically deforms as well in accordance with the movement of the horizontal piece portion 6*a*4. Furthermore, upon elastic deformation of the U-shaped portions 6*a*2 and the first vertical piece portions 6*a*1 in accordance with the above, the entire branched pieces 6*a* elastically deform. The movable housing 8 can be displaced in the front-rear direction Y with respect to the fixed housing 7 in the above manner.

As described above, when the plug connector 4 is fitted to the socket connector 1, there may be a case in which the plug connector 4 and the socket connector 1 are positionally displaced with respect each other. Furthermore, vibration may be applied to the socket connector 1 in the fitted state. In such a case, as described above, the branched pieces 6*a* of the socket terminals 6 become elastically deformed and the movable housing 8 becomes displaced with respect to the fixed housing 7; accordingly, positional displacement and vibration of the socket connector 1 can be absorbed.

While the floating mechanism described above absorbs the positional displacement and the vibration in the front-rear direction Y of the socket connector 1, positional displacement and the vibration in the width direction X and in the height direction Z can be absorbed in a similar manner with sliding contact between the socket terminals 6 and the plug terminals 4*a*. In other words, when positional displacement and vibration occur in the width direction X, while in sliding contact with each other, the contact portions 6*b* and the plug terminals 4*a* are relatively displaced with respect each other in the width direction X. Furthermore, the contact portions 6*b* and the plug terminals 4*a* are relatively displaced with respect each other while in sliding contact with each other in the height direction Z as well. If floating mechanisms for the width direction X and the height direction Z are to be provided as well, movable pieces that are capable of elastic deformation in the respective directions need to be provided and, in some cases, the socket connector 1 may need to be increased in size. However, as is the case of the socket connector 1 of the present embodiment, by having sliding contact be performed for the width direction X and the height direction Z, positional displacement during fitting and vibration while in a fitted state can be absorbed without increasing the size of the socket connector 1.

[Description of Heat Generation Suppressing Effect of Socket Connector]

When conductively connecting to a mating terminal to which a large electric current is distributed through contact of a single terminal, heat is generated due to increase in the resistance value; accordingly, there may be disadvantageous cases in which the housing is melted or the terminal is thermally cut by the heat. In order to prevent such a situation, the entire socket terminal 6 needs to be increased in size in order to reduce the resistance value of the socket terminal 6. However, with a connector provided with a terminal with increased size, it is difficult to respond to the demand of recent years to miniaturize the connectors.

On the other hand, as described above, in the socket connector 1 of the present embodiment, by providing a plurality of socket terminals 6, the electric current can be split and, furthermore, a plurality of conductive paths E that split the electric current in a parallel manner in each of the socket terminals 6 are formed. By so doing, conductive connection can be established after the electric current has been split at multiple stages in a single socket connector 1; accordingly, it will be possible to correspond to a large electric current while reducing size. Since the socket terminals 6 are formed so as to have the same shape and size and the electric current values flowing through the socket terminals 6 can be equalized, the connector can be one in which management of a larger electric current is facilitated.

As described above, by forming parallel conductive paths E in the branch contact portions 6*b*1 and splitting the electric current in a parallel manner, the resistance value can be lowered and the socket connector 1 can be one in which management of a higher electric current is facilitated. Furthermore, even in a case in which, for example, the cross-sectional area of the two branch contact portions 6*b*1 included in a single socket terminal 6 is formed smaller than those of the other portions of the socket terminal 6, by forming a plurality of parallel conductive paths E in the above manner, heat generation from the branch contact portions 6*b*1 can be suppressed.

Furthermore, by having the cross-sectional area of the branch contact portions 6*b*1 included in a single socket terminal 6 be the same and, for example, by forming the branch contact portions 6*b*1 to have the same shape and size, the values of the electric current flowing in the branch contact portions 6*b*1 can be equalized. Accordingly, the heat quantities of the branch contact portions 6*b*1 can be equalized by equalizing the resistance value such that a situation in which one of the branch contact portions 6*b*1 alone becomes high in temperature can be prevented.

As described above, by forming parallel conductive paths E in the branched pieces 6*a* and splitting the electric current in a parallel manner, the resistance value can be lowered and the socket connector 1 can be one in which management of a higher electric current is facilitated. Furthermore, even in a case in which, for example, the cross-sectional area of the two branched pieces 6*a* included in a single socket terminal 6 is formed smaller than those of the other portions of the socket terminal 6, heat generation from the branched pieces 6*a* can be suppressed.

By having the cross-sectional area of the branched pieces 6*a* included in a single socket terminal 6 be the same and, for example, by forming the branched pieces 6*a* to have the same shape and size, the values of the electric current flowing in the branched pieces 6*a* can be equalized. Accordingly, the heat quantities of the branched pieces 6*a* can be equalized by equalizing the resistance value such that a situation in which one of the branched pieces 6*a* alone becomes high in temperature can be prevented.

As described above, the socket connector 1 includes the floating mechanism. In such a connector, typically, it is desirable that a movable piece of a single terminal is formed thin and narrow in a thin shaft shape in order to facilitate elastic deformation in a flexible manner. However, when the movable piece is formed thin and narrow in width, the cross-sectional area thereof becomes smaller and the electric resistance becomes larger. In such a case, when a large electric current is distributed, the movable piece generating heat becomes high in temperature and becomes burnt black, or in the worst case scenario, may become thermally cut. Conversely, when the cross-sectional area of the movable piece is increased to suppress heat generation, elastic deformation described above will be difficult and, further, it will be difficult to respond to the demand in miniaturization of the collector. Accordingly, when focusing on the movable piece, it will be difficult to achieve both flexibility in the floating mechanism and responding to a large electric current.

Accordingly, different from the conventional terminal in which a single movable piece is provided in a single terminal, in the socket connector 1 of the present embodiment, branched pieces 6*a* included in the connection piece portion 6*d* are configured as movable pieces such that heat generation is suppressed while both increase in the cross-sectional area so as to be capable of being used under a large electric current and flexibility of the movable pieces to manage the floating mechanism are achieved.

Furthermore, by having the branched pieces 6*a* to have a narrow width, a wider space can be provided between the two branched pieces 6*a*. Accordingly, a structure in which release of heat is further facilitated is obtained.

Note that the width of the space for releasing heat is desirably a width in which at least about one branched piece 6*a* can be disposed between the branched pieces 6*a* and 6*a* and parallel to the branched pieces 6*a* and 6*a*.

The movable holes 7*a* and the opening portions 7*b* that penetrate the side walls 7*c* are formed in the fixed housing 7 of the socket connector 1, and the branched pieces 6*a* are exposed to the outside through the movable holes 7*a* and the opening portions 7*b*. By so doing, release of heat generated in the branched pieces 6*a* to the outside is facilitated such that heat release is facilitated.

As described above, by forming the parallel conductive paths E and E in the two substrate side branch connection pieces 6*c*1 included in a single socket terminal 6 and splitting the electric current in a parallel manner, the resistance value can be lowered and the socket connector 1 can be one in which management of a higher electric current is facilitated. Furthermore, by so doing, even in a case in which, for example, the cross-sectional area of the substrate side branch connection pieces 6*c*1 is formed smaller than those of the other portions of the socket terminal 6, heat generation from the substrate side branch connection pieces 6*c*1 can be suppressed.

By having the cross-sectional areas of the two substrate side branch connection pieces 6*c*1 included in a single socket terminal 6 be the same and, for example, by forming the substrate side branch connection pieces 6*c*1 to have the same shape and size, the values of the electric current flowing in the substrate side branch connection pieces 6*c*1 can be equalized. Accordingly, the heat quantities of the substrate side branch connection pieces 6*c*1 can be equalized by equalizing the resistance value such that a situation in which one of the substrate side branch connection pieces 6*c*1 alone becomes high in temperature can be prevented.

By providing a wider space between the two substrate side branch connection pieces 6*c*1, it will be possible to obtain a structure in which release of heat is further facilitated.

Note that the width of the space for releasing such a heat is desirably a width in which at least about one substrate side branch connection piece 6*c*1 can be disposed in parallel between the substrate side branch connection pieces 6*c*1 and 6*c*1.

A case in which the increase in temperature of the socket terminals 6 during conductive contact with the plug terminals 4*a* is suppressed to 30 K or under while the maximum rated current is 15 A will be exemplified to describe the performance of the socket terminals 6 of the present embodiment in detail. Since each socket terminal 6 includes two branch contact portions 6*b*1, a single terminal pair 6A includes four branch contact portions 6*b*1. Furthermore, a total of four contact portions 6*b*2 included in the branch contact portions 6*b*1 are conductively connected to the plug terminal 4*a*. As described above, by coming in contact with the plug terminal 4*a* at four points, even if the electric current value is increased to about 28.0 A, the increase in temperature can be suppressed to 30 K or under. Furthermore, even if one of the four contact portions 6*b*2 is separated from the plug terminal 4*a* and the contact with the terminal pairs 6A is at three points, the increase in temperature can be suppressed to 30 K or under even if the electric current value is increased to about 23.0 A. Accordingly, the requirement of a maximum rated current of 15 A can be sufficiently met with some margin. Furthermore, even if the contact between the plug terminal 4*a* and the contact portions 6*b*2 is at two points, the increase in temperature can be suppressed to 30 K or under even if the electric current value is increased to about 17.5 A.

Accordingly, even if by any chance about two contact portions 6*b*2 of the socket terminals 6 in the terminal pair 6A are separated from the plug terminal 4*a*, the requirement of the maximum rated current of 15 A can be met sufficiently.

As described above, in the socket connector 1 of the present embodiment, the electric current can be split by forming a plurality of conductive paths E; accordingly, it will be possible to correspond to a large electric current while reducing size.

Second Embodiment [FIGS. 17 to 23]

A DIP type socket connector has been exemplified as the socket connector 1 of the first embodiment described above. Conversely, as illustrate in FIG. 17, a socket connector 9 that is a surface mounting type mounted on the substrate 2 can be used. In such a case, socket terminals 10 included in the socket connector 9 include, as illustrated in FIGS. 18 to 23, substrate connection portions 11 including soldering portions 12 that are bent and elongated parallel to the substrate 2 from the second connection portions 6*e*. Furthermore, each of the substrate connection portions 11 may not be provided with the substrate side branch connection piece 6*c*1 and may include a single soldering portion 12 that has a width that is suitable for soldering. The socket connector 9 enables various mounting methods to be performed according to the mounting position.

Modification:

In the embodiments described above, exemplifications of socket connectors 1 and 9 that are provided with four socket terminals 6 and 10 forming two pairs of terminal pairs 6A have been given. Conversely, for example, six or more socket terminals 6 forming three or more pairs of terminal pairs 6A may be provided. On the other hand, in a case in which the electric current value is small and there is no need to provide four socket terminals 6, the socket connector 1 may be provided with only a pair of opposing socket terminals 6. By so doing, the socket connector 1 can be made smaller.

In each of the embodiments described above, an exemplification of a socket connector 1 including two substrate side branch connection pieces 6*c*1 has been given; however, three or more may be provided, for example.

Furthermore, in a similar manner, in each of the embodiments described above, an exemplification of a socket connector 1 including two branched pieces 6*a* has been given; however, three or more may be provided. Furthermore, in a similar manner, in each of the embodiments described above, an exemplification of a socket connector 1 including two branch contact portions 6*b*1 has been given; however, three or more may be provided. By increasing the number of substrate side branch connection pieces 6*c*1, branched pieces 6*a*, and branch contact portions 6*b*1, the number of parallel conductive paths E is increased and the resistance value can be lowered; accordingly, the socket connector 1 can be one in which management of a larger electric current is facilitated without an increase in size.

By splitting the electric current in the above manner, heat generation suppressing effect of the socket terminals 6 can be increased. Furthermore, in such a case, by providing sufficient space for releasing heat between the substrate side branch connection pieces 6*c*1, between the branched pieces 6*a*, and between the branch contact portions 6*b*1 of a single socket terminal 6, the heat generation suppressing effect created by splitting the electric current can be increased further.

In each of the exemplary embodiments described above, an example in which the housing 5 includes a fixed housing 7 and a movable housing 8 relatively displaceable with respect to the fixed housing 7, and the connection piece portion 6*d* supports the movable housing 8 in a relatively displaceable manner with respect to the fixed housing 7 has been given. Conversely, in a case in which the floating mechanism is not needed, a single housing in which the fixed housing 7 and the movable housing 8 are integrally configured may be provided. In such a case, the connection piece portion 6*d* may be left to play a role of merely connecting the contact portions 6*b* and the substrate connection portions 6*c* to each other and splitting the electric current in a parallel manner.

In each of the embodiments described above, an exemplification of the first connection portion 6*f* connected to the two branch contact portions 6*b*1 has been given; however, the first connection portion 6*f* may be connected to the two branched pieces 6*a*. Furthermore, an exemplification of the second connection portion 6*e* connected to the two branched pieces 6*a* has been given; however, the second connection portion 6*e* may be connected to the two substrate side branch connection pieces 6*c*1.

In each of the embodiments described above, an example in which the electric current flows from the plug terminals 4*a* towards the socket terminals 6 has been illustrated. However, opposite to the above, the configuration may be such that the electric current flows from the socket terminals 6 towards the plug terminals 4*a*.

REFERENCE SIGNS LIST

1 socket connector (first embodiment)
2 first substrate
2*a* connection pad
2*b* through-hole
3 second substrate
4 plug connector
4*a* plug terminal (connection object)
4*a*1 contact surface
5 housing
5*a* movable space
6 socket terminal (first embodiment)
6A terminal pair
6*a* branched piece
6*a*1 first vertical piece portion
6*a*2 inversed U-shaped portion
6*a*3 second vertical piece portion
6*a*4 horizontal piece portion
6*b* contact portion
6*b*1 branch contact portion
6*b*2 contact portion
6*b*3 bent portion
6*b*4 elastic piece portion
6*b*5 distal end portion
6*c* substrate connection portion
6*c*1 substrate side branch connection piece
6*d* connection piece portion
6*e* second connection portion
6*e*1 second fixing portion
6*f* first connection portion
6*f*1 first fixing portion
6*f*2 recessed portion
7 fixed housing
7*a* movable hole
7*b* opening portion
7*c* side wall
7*d* inner wall
7*e* side wall
8 movable housing
8*a* terminal insertion hole
8*b* accommodation portion
8*c* heat releasing hole
9 socket connector (second embodiment)
10 socket terminal (second embodiment)
11 substrate connection portion (second embodiment)
12 soldering portion
E conductive path

The invention claimed is:

1. A connection structure of a connector, comprising:

a connector that conductively connects a connection object to a substrate;

the connector including a housing, and a plurality of terminals held by the housing; and the plurality of terminals each including a substrate connection portion that comes into conductive contact with a common connection pad provided on the substrate, a contact portion that comes into conductive contact with the connection object, and a plurality of branched pieces connecting, in a parallel manner, each substrate connection portion and the corresponding contact portion, wherein the plurality of branched pieces is disposed in a parallel manner while leaving a space for releasing heat in which at least the plate area of one branched piece can be disposed in a horizontal manner between one branched piece and the other branched piece.

2. A connector, comprising:

a housing mounted on a substrate;

a plurality of terminals held by the housing; and each of the terminals including a substrate connection portion that conductively connects to a common connection pad provided on the substrate, a contact portion that comes into conductive contact with a common connection object that is a connection mate of the connector, and a plurality of branched pieces forming parallel conductive paths that connect each of the substrate connection portion and the corresponding contact portion to each other, wherein the plurality of branched pieces is disposed in a parallel manner while leaving a space for releasing heat in which at least the plate area of one branched piece can be disposed in a horizontal manner between one branched piece and the other branched piece.

3. The connector according to claim 2, wherein the contact portion includes a plurality of branch contact portions that form parallel conductive paths.

4. The connector according to claim 2, wherein the substrate connection portion includes a plurality of branch substrate connection portions that form parallel conductive paths.

5. The connector according to claim 2, wherein the housing includes a fixed housing and a movable housing relatively displaced with respect to the fixed housing, the substrate connection portion is provided in the fixed housing, the contact portion is provided in the movable housing, and the branched pieces are movable pieces that support the movable housing in a relatively displaceable manner with respect to the fixed housing.

6. The connector according to claim 2, wherein the housing accommodates the terminals therein and includes an opening portion that exposes the terminals externally.

7. The connector according to claim 5, wherein the movable pieces each include an elongation portion that is elongated from the substrate connection portion, and a bent portion bent back from an end portion of the elongation portion, and the elongation portion is formed such that a width on a substrate connection portion side is wider than a width of the bent portion.

8. The connector according to claim 2, wherein the plurality of terminals are disposed to oppose each other and be in conductive contact with the connection object between the contact portion of one terminal and the contact portion of the other terminal.

9. The connector according to claim 2, wherein the plurality of terminals has same shape and size.

* * * * *